United States Patent [19]

Weiss

[11] 4,358,068

[45] Nov. 9, 1982

[54] THREAD RETAINER

[75] Inventor: Hans-Joachim Weiss, Ulisbach, Switzerland

[73] Assignee: Rieter Machine Works, Ltd., Winterthur, Switzerland

[21] Appl. No.: 177,628

[22] Filed: Aug. 13, 1980

[51] Int. Cl.[3] ..... B65H 49/02

[52] U.S. Cl. ..... 242/131; 57/352; 242/152.1

[58] Field of Search ..... 242/131, 131.1, 152, 242/152.1, 152 M, 45; 24/115 L, 136 R, 155 BR, 244; 66/125 R, 132 T, 133, 134; 57/352, 353

[56] References Cited

U.S. PATENT DOCUMENTS

| | | | |
|---|---|---|---|
| 110,725 | 1/1871 | Barstow | 24/244 X |
| 1,360,018 | 11/1920 | Rasmussen | 242/45 |
| 1,785,987 | 12/1930 | Stewart | 242/152.1 |
| 2,263,278 | 11/1941 | Senna | 242/45 |
| 3,304,026 | 2/1967 | Bucklow et al. | 242/131 |

FOREIGN PATENT DOCUMENTS

| | | | |
|---|---|---|---|
| 537341 | 4/1959 | Belgium . | |
| 717844 | 1/1932 | France | 242/152.1 |
| 17289 | of 1912 | United Kingdom . | |
| 1529775 | 10/1978 | United Kingdom . | |

*Primary Examiner*—Leonard D. Christian
*Attorney, Agent, or Firm*—Kenyon & Kenyon

[57] ABSTRACT

The thread retainer has a tube which is slotted from the side to form an access opening for a thread and a gate member in the form of a ball which is movably mounted in the tube. The ball cooperates with a second ball to define a thread passage with curvilinear walls. The movable ball may move under gravity or may be spring biased to permit entry of the thread into the thread passage.

19 Claims, 4 Drawing Figures

THREAD RETAINER

The present application relates to a thread retainer, particularly but not exclusively for use in a creel.

PRIOR ART

In U.S. Pat. No. 2,588,053 there is described a thread-guide which is openable in response to specific forces applied by a thread within the guide to permit release of the thread. This is achieved by forming the guide opening as an elongate slot having one open end which is normally closed off by a leaf-spring extending across the slot but which is openable by deformation of the leaf-spring.

The guide described in U.S. Pat. No. 2,588,053 is intended for use in a creel in which two thread packages are to be disposed side by side with the leading end of one package tied to the trailing end of the adjacent package. The openable guide is intended to provide a guide eye for guiding a thread during unwinding from one of the packages. The thread is to be released after unwinding from the one package is completed, to enable unwinding from the other package via a different guide eye.

Apart from the fact that the elements making up the openable guide in U.S. Pat. No. 2,588,053 have sharp edges, so that thread damage is to be expected, the arrangement shown in the U.S. Patent exhibits the following disadvantages for use as a mere thread retainer, when no thread guiding function is required:

(a) the thread must travel the full length of the slot in contact with the leaf spring before it has deformed the latter sufficiently to enable the thread to escape from the guide, (b) the resistance of the spring to deformation must be reasonably high to ensure that the guide remains closed during normal unwinding of thread from the one package, which requirement is in contradiction to the requirement of easy release of the thread at the completion of unwinding of the one package, (c) the force required to deform the spring is liable to variation over the life of the spring due to repeated deformation operations, many of which are dependent upon the skill of the attendant, and (d) insertion of a continuous thread into the guide requires two operations on the part of the attendant; firstly, opening of the guide by deformation of the spring, and secondly, insertion of the thread into the thus opened slot, followed by release of the spring to reclose the guide.

In U.S. Pat. No. 1,364,987 (FIG. 3) there is shown a holder for string in which a weight, in the form of a ball, is used to clamp an end portion of the string against the edge of an outlet opening from the holder when no withdrawal tension is applied to the string. This is however not an openable guide in the same sense as the guide in U.S. Pat. No. 2,588,053 since a continuous length of thread cannot be introduced into the outlet guide opening except by passing it axially therethrough. Moreover, the ball weight continuously applies pressure to the string leaving the holder, so that the arrangement would be liable to cause variable (and therefore uncontrollable) damage in a system involving sensitive threads of synthetic plastics material.

BRIEF SUMMARY OF THE INVENTION

It is an object of the present invention to provide a thread retainer which will temporarily retain a thread in a desired position and which enables both easy and quick insertion of the thread into the retainer and easy and quick release of the thread from the retainer. The term "thread" in this specification means any continuous elongate thread-like body, including but not limited to yarn, filament and wire.

The invention provides a thread retainer comprising a a carrier defining an open-ended thread passage having an axis passing through the open ends and a side access opening permitting a continuous length of thread to be extended through the passage by movement into the passage via the access opening in a thread entry direction transverse to the axis of the passage axis, b at least one gate member movable on the carrier for controlling access to the passage via the access opening, c an abutment surface on the carrier, and d guiding means on the carrier for guiding movement of the gate member in predetermined directions towards and away from a position of contact with the abutment surface and transverse to both the thread entry direction and the axis of the passage.

In the preferred form of the invention, the guiding means forms part of a confining means defining a zone of free movement of the gate member. In this specification, the expression "free movement" when applied to the gate member, means the member is free for movement under its own weight.

The guiding means preferably comprises elements which also serve as passage defining means defining the open ended passage. However, in principle, the passage defining means and the guiding means may be completely separate.

The carrier may be in the form of a hollow body, e.g. tubular. The open sided thread passage may be provided in part by a slot extending through the wall of the hollow body, e.g. transverse to the longitudinal axis of a tubular body. The guiding means may be provided by surfaces within the hollow body, and these surfaces may be integral with the body or formed separately therefrom and mounted therein. The carrier may include or have associated therewith means for use in mounting the carrier in a predetermined disposition—for example, where the gate member is capable of free movement. This predetermined disposition may be such that the side access opening is normally closed.

The gate membber may have an external, curvilinear surface, at least in a contact region where it contacts the abutment surface. A spherical gate member is preferred. The abutment surface may also be curvilinear, e.g. spherical. The abutment surface may be provided on a second gate member movable relative to the carrier.

The dimensions of the thread passage may be so chosen in relation to the dimensions of the thread, or threads, with which it is intended to be used, that the thread or threads can lie in the passage without any application of pressure from the gate member. However, where it is important to position the thread accurately, while retained by the retainer, the dimensions of the passage may correspond approximately with those of the thread to be located in it.

BRIEF DESCRIPTION OF THE DRAWINGS

By way of example, embodiments of the invention will now be described with reference to the accompanying drawings, in which.

DETAILED DESCRIPTION

Figure 1:
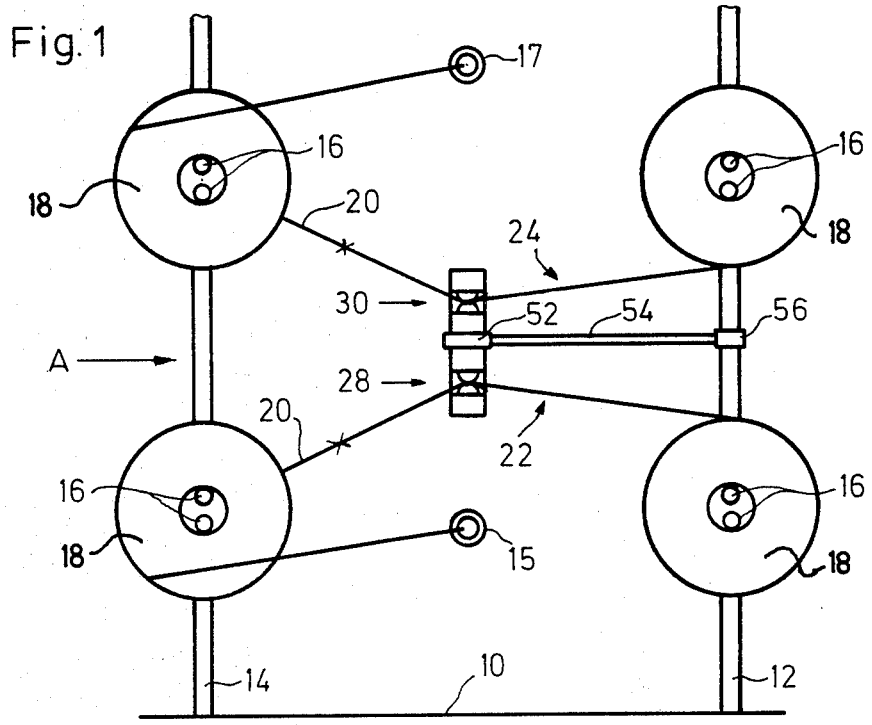
FIG. 1 is a diagrammatic front elevation of a creel incorporating a thread retainer in accordance with the invention.
Figure 2:
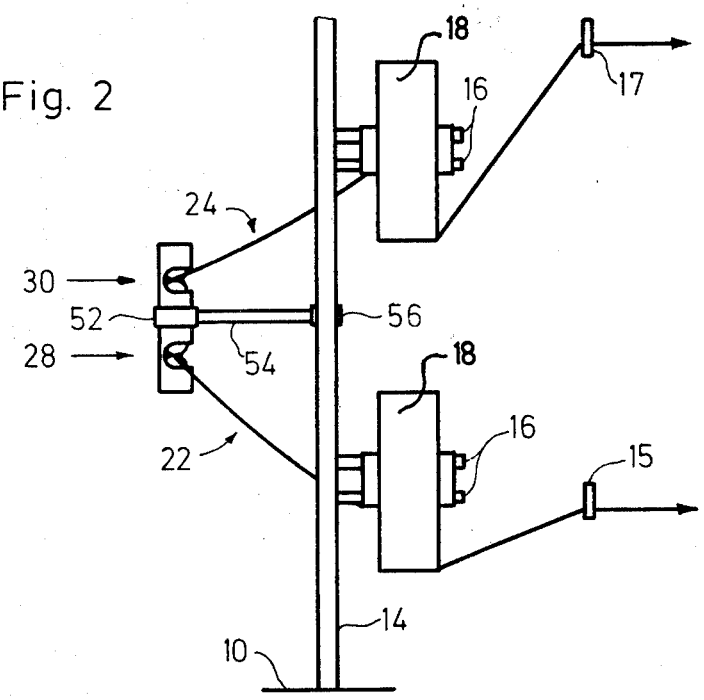
FIG. 2 is a side elevation of part of the same creel seen in the direction of arrow A in FIG. 1.

The creel shown diagrammatically in FIGS. 1 and 2 comprises a base 10 and vertical uprights 12,14. Each upright carries a plurality of horizontal stub shafts 16 on which respective thread packages 18 can be mounted for unwinding. Only two sets of stub shafts, and the corresponding packages, are shown on each upright in the drawing, but more could be provided.

The packages are arranged in pairs, the packages of a pair being at the same horizontal level. The leading end of one package in the lower pair is taken through a guide 15 mounted, by means not shown, in front of the uprights 12,14 and the leading end of one package in the upper pair is taken through a similar guide 17. The packages are then unwound via these guides.

The system is of known type in which a "tail" 20 from the package currently being unwound is tied to the leading end of the other package of the respective pair, so that thread can be unwound continuously, being taken from the packages in sequence. Systems of this type are described, for example, in Japanese Gebrauchsmuster No. 52-128 747 and in U.S. Pat. No. 4,235,393. As is well known, problems can arise in dealing with the resultant loops of thread between successive packages in the sequence. Two such loops, indicated 22,24 respectively, are shown in FIG. 1. In accordance with the present invention, each loop can be held by a respective thread retainer, 28 or 30 respectivly. Since these retainers are substantially identical, one only will be described by reference to FIG. 3.

The illustrated retainer comprises a frame portion, or carrier, in the form of a short length of cylindrical section, open-ended tube 34 having a bore 32. Other forms of hollow body could perform the same function. A slot 36 extends across more than half of the diameter of the tube. The edges of this slot within the wall thickness of the tube partially define an open-ended thread passage 38 having an axis passing through the open ends and extending transverse to the longitudinal axis of the tube itself.

The open end of the slot 36 provides a side access opening permitting a continuous length of thread to be extended through the passage 38 by movement into the passage in a thread entry direction transverse to the axis of the passage 38.

Figure 3:
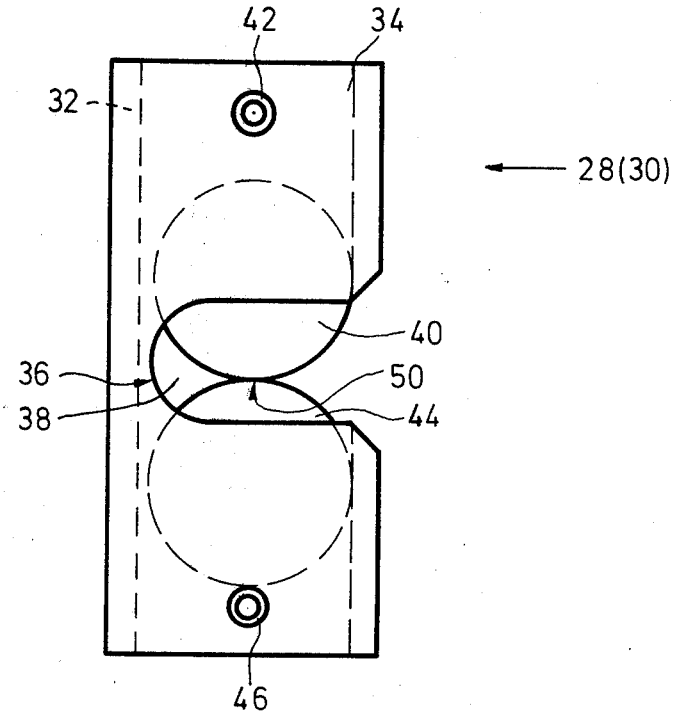
FIG. 3 is a side elevation of the thread retainer of FIG. 1 drawn to a larger scale and FIG. 4 is a plan view of another form of thread retainer.

Access to this passage 38 from the side thereof, i.e. longitudinally of slot 36, is restricted by a spherical gate member 40, in the form of a solid ball e.g. of metal or other suitable material. The diameter of the ball is slightly less than the diameter of the bore of the tube and the ball 40 is free to move in an upward direction along the bore 32 from its position shown in FIG. 3, until reaching a stop or abutment surface 42 in the form of a tubular pin mounted in a suitable opening in the wall of the tube 34 and extending diametrically across the bore 32. Movement of the ball 40 in a downward direction along the bore of the tube from its position shown in FIG. 3 is prevented by contact with a means such as a second sphere 44, which may also be in the form of a metal ball, and which provides an abutment surface engaged by the ball 40. Sphere 44 is supported on a second pin 46, similar to the pin 42 and similarly mounted and disposed. The disposition of the carrier tube 34 shown in FIG. 3 is its normal operating position, which will be assumed in all of the following description.

It will be appreciated that ball 40 is free to move under its own weight within a space defined by the internal surface of tube 34, ball 44 and stop pin 42—the latter three elements therefore constituting a confining means for ball 40 and the internal surface of the tube 34 constituting a guiding means for such free movement. The contact pressure between the balls 40,44 is dependent on the weight of the ball 40 and is readily adjustable by substituting a ball of the same diameter but different weight. Thus, the ball 40 is movably mounted between a position within the slot 36 abutting the abutment surface provided by the sphere 44 and a position spaced from the abutment surface in order to permit passage of a thread into and out of the thread passage 38.

The diameter of the ball 44 is such that the contact point 50 between the balls lies roughly in the middle of the slot 36. The complete thread passage 38 is therefore defined by the edges of the slot 36, at the inner end thereof, and the oppositely facing curvilinear surfaces on the balls 40, 44, which latter provide a "gate" controlling access to passage 38 along slot 36. Access to the passage is provided simply by lifting the ball 40 against its own weight, and this can be effected easily by pushing a continuous length of thread (e.g. the loop 22 or 24) sideways (i.e. transverse to its own length) along the slot 36, preferably with the axis of the inserted thread portion aligned approximately with the axis of the passage 38. As seen in FIG. 3, the entrance to the slot is chamfered to facilitate lead-in of a thread.

After insertion of the thread, the ball 40 will return to rest against the ball 44, but a thread of normal dimensions will rest freely in the passage 38 without any pressure applied thereto by the ball 40. Thus, when there is no tension in the thread, e.g. as in the loop 22 in FIG. 1, the thread will be retained easily by the ball 40 within the passage 38. However, assume the shortest path of the thread, when under longitudinal tension, lies outside the passage 38, to the right of and either above or below the slot 36 as seen in FIGS. 2 and 3. The thread will be able to leave the retainer quite easily to adopt this shortest path by again lifting the ball 40 to permit release along the slot 36 and this will be effected automatically when longitudinal tension is applied to the thread and straightens out the loop 22 or 24.

Any suitable means can be used to mount the thread retainers 28,30 at suitable locations relative to their respective associated package pairs. The illustrated system comprises a holder 52 having upper and lower resilient sockets (not visible in the drawings) which receive and grip the ends of the tubes 34 of respective retainers 28,30. Holder 52 is mounted on the upright 12 by means of an L-shaped arm 54 and a clamp-ring 56. As best seen in FIG. 2, the shorter limb of the L-shaped arm 54 extends rearwardly from the upright 12, that is, in a direction away from the guides 15, 17, so that the thread retainers are displaced rearwardly from the main working zone of the creel. This lessens the risk of interference of the loops 22,24 with operations in the working zone. It will be apparent that two, or more, thread retainers could be formed within a single tube having a plurality of slots such as the slot 36.

If the tube 34 were turned end for end, ball 44 would serve as a movable gate member or element and ball 40 as a confining element, but the contact region between the balls would be displaced towards the edge of slot 36 which is uppermost in FIG. 3 but which would be lowermost in the assumed altered configuration. The position of pin 42 can be selected to ensure that the device remains openable, i.e. the contact zone of the balls lies within the slot 36, in this upended disposition.

It will be appreciated that the movable gate element 40 is not necessarily in the form of a ball. Other elements which are freely slidable for at least a limited distance along the bore of the tube could perform the same function. Similarly, the confining gate element 44 is not necessarily in the form of a ball. However, the contact zone between the movable element and the confining element is preferably as small as possible i.e. is preferably produced between two curvilinear surfaces. Any flat surfaces in this zone will tend to collect dirt and will also increase the tendency to fibrillate the thread by friction during thread insertion.

When at least one of the movable gate element and the confining gate element is to have a curvilinear surface in the contact zone, then there are substantial advantages to the use of a ball for that element. Firstly, a ball tends to rotate about its own centre when subjected to forces such as those produced on the gate elements in the present thread retainer. Thus, wear on the surface of the ball is gradually spread over the whole of that surface instead of being localised in one or more specific regions. Further, contact of the ball with the confining elements surrounding it during such rotation tends to have a "self cleaning" effect, removing fibrils and fibre paricles which may have settled on the ball or the confining surfaces. Further, balls (whether of metal or other materials such as glass, ceramic or plastics material) are readily available and are produced to closely defined standards regarding diameter, weight and surface finish.

It will be apparent therefore that there are substantial advantages to having each gate element in the form of a ball which is at least free to rotate about its own centre when mounted in the carrier/guide tube. The confining element could however be a plate-like element or even a pin extending across the bore of the tube to be engaged by the movable gate element. The confining element, whether it presents a curvilinear or plane surface to the gate element, could be formed integral with the carrier, whether or not the latter is in the form of a tube. Although the carrier structure itself is not necessarily in the form of a tube, this is the preferred form of carrier because of the ready availability of suitable tubes which can be matched to the diameters of readily available balls. However, the carrier could be made, e.g., as a skeleton structure from sufficient rods connected together to perform the required guiding/confining functions.

Figure 4:
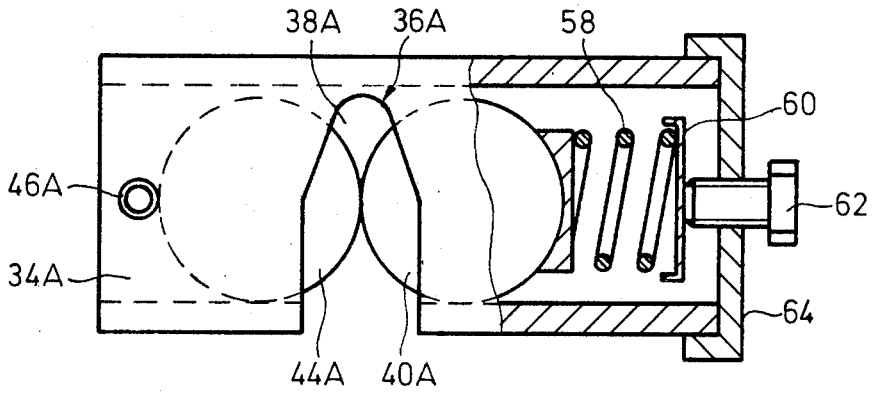

The movable gate element in the retainer as illustrated and described is permitted free movement relative to the carrier. This is not, however, essential. For example, as shown in FIG. 4, a spring 58, or other biasing element, may extend between the movable gate element 40A and a suitable spring retainer 60 on the carrier. Adjustment means may be provided to adjust the contact pressure between the movable gate element and its associated confining element 44A in so far as this contact pressure is determined by the biasing means, e.g. as shown in FIG. 4 the spring retainer 60 may be mounted on a screw 62 enabling adjustment of the preloading of the spring 58 by rotation of screw 62 in a screw threaded opening in a suitable cap 64 on the tube 34A. Where bias means is provided, particularly an adjustable bias means, the retainer can be made independent of the weight of the movable gate element, and therefore of the disposition of the thread retainer during operation. For example, the embodiment shown in FIG. 4 may be assumed to be viewed in plan with the longitudinal axis of the tube 34A horizontal, enabling a vertical thread run through the passage 38A. This retainer could also be used with the axis of tube 34A vertical, with either end of the tube uppermost provided a sufficiently strong spring is used if it must bear the weight of the balls.

Even where the retainer is dependent upon the weight of the movable gate element, it is not essential to use a vertical path of movement for the movable gate element—this path could extend upwardly and to one side away from the confining element. In this way, two or possibly more movable gate elements could be associated with a single confining element e.g. two balls contacting a single ball confining element at respective locations spaced on the surface of the confining element, with the two balls being guided for movement on respective paths extending substantially radially outwardly from the confining element. This multiple thread retainer arrangement could be incorportated in a single carrier structure. In any case in which the contact pressure is dependent upon the weight of the movable gate element, this pressure may be adjustable by placing additional weights upon the gate element; e.g., in FIG. 3 the tube 34 could be extended upwardly and the pin 42 could be displaced further along the tube to enable the insertion of an additional weighting ball between the ball 40 and the displaced pin. It will be apparent that the pin 42 could be dispensed with, but has the advantage that the thread retainer including this pin is a selfcontained structure which can be transported in any desired disposition without risk of loss of the balls 40,44.

The shape and dimensions of the slot 36 will depend to some extent upon the purpose for which the creel, and therefore the retainer, is intended. If, as described, the retainer is simply holding a loop of thread during unwinding of packages, e.g. infeeding of thread to a texturising machine, then a rounded end is preferred on the slot 36 and the dimensions of the passage 38 are selected in relation to the thread so as to avoid any pressure on the thread while it is located in the retainer. However, the retainer could serve also to locate accurately a portion of thread, e.g. if the thread is to be gripped by an automatic gripping apparatus of a testing machine. In this case, it may be preferred to ensure that the thread is contacted around a substantial portion of its periphery within the thread passage. For this purpose, the end of the slot 36A in FIG. 4 has been formed in a V-shape.

It will be appreciated that the present invention has provided a thread retainer comprising a thread passage (in FIG. 3, passage 38) having an axis, first thread passage defining means (in FIG. 2, slot 36 and ball 44)

partially surrounding the axis but leaving a side access opening to the passage, and second thread passage defining means (in FIG. 2, ball 40) capable of limited free movement relative to the first to open and close the side access opening. The first thread passage defining means may, but does not have to, comprise a plurality of elements, e.g. a carrier and a confining element, formed separately from each other but adapted to be retained in fixed relative positions during normal operation of the retainer.

It will further be appreciated that the invention has provided a thread retainer comprising a thread passage having an axis and a side access opening permitting insertion of a continuous length of thread into the passage in a first, entry, direction transverse to the axis, and a pair of gate members controlling access to the passage via the access opening. At least one of the gate members is movable in a direction transverse both to the thread entry direction and to the axis. The gate members is separable in response to forces applied thereto by a continuous length of thread to permit movement of the thread into and out of the passage via the access opening. By means of this arrangement, it is possible to minimize the degree of relative movement of the gate members which is required to enable opening of the "gate" and it is also possible to control accurately the force which a thread must apply to the gate members to separate them. With such an arrangement insertion and removal of a thread can be achieved without an operator, whether human or mechanical, performing any direct action upon the gate.

I claim:

1. A thread retainer comprising a carrier defining an open-ended thread passage having an axis passing through said open-ends thereof and a side access opening permitting a continuous length of thread to be extended through said passage by movement into the passage via said access opening in a thread entry direction transverse to said axis, at least one gate member movable on said carrier for controlling access to said passage via said opening, an abutment surface on said carrier, guiding means on said carrier for guiding movement of said movable gate member in predetermined directions towards and away from a position of contact with said abutment surface and transverse to both said thread entry direction and said axis, and said side access opening being closed when said gate member contacts said abutment surface and being opened when said gate member moves out of contact with said abutment surface.

2. A thread retainer as claimed in claim 1 wherein said guiding means provides part of a confining means defining a zone of free movement of the movable gate member.

3. A thread retainer as claimed in claim 1 wherein said abutment surface is curvilinear.

4. A thread retainer as claimed in claim 3 wherein said abutment surface is provided on a spherical element supported on the carrier.

5. A thread retainer as claimed in claim 1 wherein the movable gate member has a curvilinear surface at least on a portion thereof which contacts the abutment surface.

6. A thread retainer as claimed in claim 5 wherein said movable gate member is spherical.

7. A thread retainer as claimed in claim 1 wherein said carrier comprises a tube, the thread passage being provided in part by a slot transverse to the longitudinal axis of the tube and the guiding means being provided by surfaces within the tube.

8. A thread retainer as claimed in claim 1 and further comprising bias means biasing the movable gate member towards the abutment surface.

9. A creel comprising support means for supporting a plurality of thread packages and at least one retainer as claimed in claim 1 for retaining a length of thread extending from at least one of said packages.

10. A creel as claimed in claim 9 wherein said retainer is disposed between a pair of support means for supporting a pair of packages so as to retain a loop of thread extending between said packages in use.

11. A creel as claimed in claim 9 or claim 10 comprising guide means defining a thread path which lies outside said thread passage when the thread is under longitudinal tension.

12. A thread retainer as set forth in claim 1 wherein said passage is dimensioned relative to the thread to permit the thread to lie in said passage without application of pressure from said gate member.

13. A thread retainer comprising a carrier defining a thread passage along an axis and an access opening to said passage extending transverse to said axis;

means defining an abutment surface within said carrier; and a gate means movably mounted in said carrier in a direction transverse to said axis and said access opening between a position within said access opening abutting said abutment surface and a position spaced from said abutment surface to permit passage of a thread thereby into and out of said passage.

14. A thread retainer as set forth in claim 13 wherein said gate means is freely movable in said carrier.

15. A thread retainer comprising a tube having a bore and a slot extending transversely of said bore;

means within said tube defining an abutment surface;

a ball movably mounted within said bore for movement between a first position abutting said abutment surface and a second position spaced from said abutment surface, whereby in said first position, said slot, said ball and said abutment surface define a thread passage extending transversely of said tube and in said second position, said ball permits passage of a thread transversely into and out of said passage through said slot.

16. A thread retainer as set forth in claim 15 wherein said means is a second ball.

17. A thread retainer as set forth in claim 16 which further comprises a first stop in said tube for abutting said first ball in said second position thereof and a second stop abutting said second ball in said first position.

18. A thread retainer as set forth in claim 17 wherein said second ball is movably mounted in said bore.

19. A thread retainer as set forth in claim 1 wherein said gate member is in point contact with said abutment surface when said side access opening is closed thereby.

* * * * *